US010259231B2

(12) United States Patent
Odaka et al.

(10) Patent No.: US 10,259,231 B2
(45) Date of Patent: Apr. 16, 2019

(54) LIQUID DISCHARGE HEAD INCLUDING A FILTER AND A SUPPLY CHANNEL, LIQUID DISCHARGE DEVICE, AND LIQUID DISCHARGE APPARATUS

(71) Applicants: Toshimichi Odaka, Kanagawa (JP); Takahiro Yoshida, Ibaraki (JP); Takakazu Kihira, Ibaraki (JP); Takayuki Nakai, Kanagawa (JP)

(72) Inventors: Toshimichi Odaka, Kanagawa (JP); Takahiro Yoshida, Ibaraki (JP); Takakazu Kihira, Ibaraki (JP); Takayuki Nakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/920,612

(22) Filed: Mar. 14, 2018

(65) Prior Publication Data

US 2018/0272730 A1 Sep. 27, 2018

(30) Foreign Application Priority Data

Mar. 21, 2017 (JP) ..... 2017-054104

(51) Int. Cl.

| | |
|---|---|
| ***B41J 2/14*** | (2006.01) |
| ***B41J 2/175*** | (2006.01) |
| ***B41J 2/18*** | (2006.01) |

(52) U.S. Cl.

CPC ..... *B41J 2/17563* (2013.01); *B41J 2/1433* (2013.01); *B41J 2/175* (2013.01); *B41J 2/18* (2013.01)

(58) Field of Classification Search

CPC ..... B41J 2/17563; B41J 2/1433; B41J 2/175; B41J 2/18

See application file for complete search history.

(56) References Cited

U.S. PATENT DOCUMENTS

| | | | | |
|---|---|---|---|---|
| 8,562,119 | B2 * | 10/2013 | Xie | B41J 2/1404 347/54 |
| 2015/0246536 | A1 * | 9/2015 | Yoshida | B41J 2/14274 347/47 |
| 2016/0185113 | A1 | 6/2016 | Yoshida et al. | |
| 2017/0096015 | A1 | 4/2017 | Odaka et al. | |
| 2017/0120602 | A1 | 5/2017 | Nakai et al. | |
| 2017/0239949 | A1 | 8/2017 | Yoshida | |
| 2017/0253062 | A1 | 9/2017 | Murakami et al. | |
| 2017/0297333 | A1 | 10/2017 | Kohda et al. | |

FOREIGN PATENT DOCUMENTS

| | | |
|---|---|---|
| JP | 2014-151539 | 8/2014 |

* cited by examiner

*Primary Examiner* — Henok Legesse
(74) *Attorney, Agent, or Firm* — Oblon, McClelland, Maier & Neustadt, L.L.P.

(57) ABSTRACT

A liquid discharge head, includes a nozzle from which liquid is discharged, an individual chamber communicating with the nozzle, a supply channel communicating with the individual chamber, the liquid flowing through the supply channel in a first direction, and a filter disposed upstream of the supply channel, the liquid filtering through the filter in a second direction. The first direction intersects the second direction, and the supply channel includes an inlet disposed at a position overlapping the filter in the second direction.

11 Claims, 10 Drawing Sheets

LIQUID DISCHARGE HEAD INCLUDING A FILTER AND A SUPPLY CHANNEL, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-054104, filed on Mar. 21, 2017 in the Japan Patent Office, the entire disclosures of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head for discharging a liquid includes a filter for removing foreign matter and the like from a liquid supplied to an individual chamber communicating with one or more nozzles formed in the head.

For example, a liquid supply apparatus is known that includes a liquid supply chamber communicating with a nozzle, a liquid introduction channel communicating with a liquid storage tank in which liquid is stored, and a liquid channel communicating the liquid introduction channel with the liquid supply chamber. The liquid channel includes a filter, a first chamber, and a second chamber. The filter filters the liquid flowing through the liquid channel. The first chamber is disposed upstream of the filter and below the filter. The second chamber is disposed downstream of the filter and above the filter. In a part in which the filter is provided, a height of the second chamber is lower than a height of the first chamber in a vertical direction.

SUMMARY

In an aspect of this disclosure, a novel liquid discharge head includes a nozzle from which liquid is discharged, an individual chamber communicating with the nozzle, a supply channel communicating with the individual chamber, the liquid flowing through the supply channel in a first direction, and a filter disposed upstream of the supply channel, the liquid filtering through the filter in a second direction that intersects with the first direction, and the supply channel including an inlet disposed at a position overlapping the filter in the second direction.

In another aspect of this disclosure, a liquid discharge device includes the liquid discharge head as described above.

In still another aspect of this disclosure, a novel liquid discharge apparatus includes the liquid discharge device as described above.

In yet still another aspect of this disclosure, a novel liquid discharge head includes a nozzle from which liquid is discharged, an individual chamber communicating with the nozzle, a supply-side fluid restrictor communicating with the individual chamber, a discharge-side fluid restrictor communicating with the individual chamber, the liquid flowing through the discharge-side fluid restrictor in a first direction, and a discharge-side filter disposed downstream of the discharge-side fluid restrictor, the liquid filtering through the discharge-side filter in a second direction that intersects with the first direction, and the discharge-side fluid restrictor including an outlet disposed at a position overlapping the discharge-side filter in the second direction.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
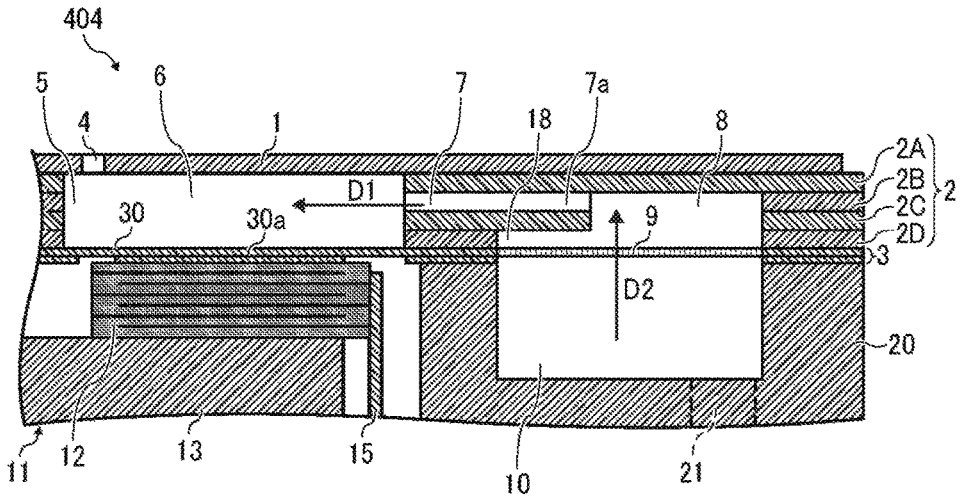
FIG. 1 is a cross-sectional view of a liquid discharge head according to a first embodiment of the present disclosure in a direction perpendicular to a nozzle array direction.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise. Hereinafter, a "liquid discharge head" is referred to as simply a "head".

Embodiments of the present disclosure are now described with reference to the attached drawings.

Figure 2:
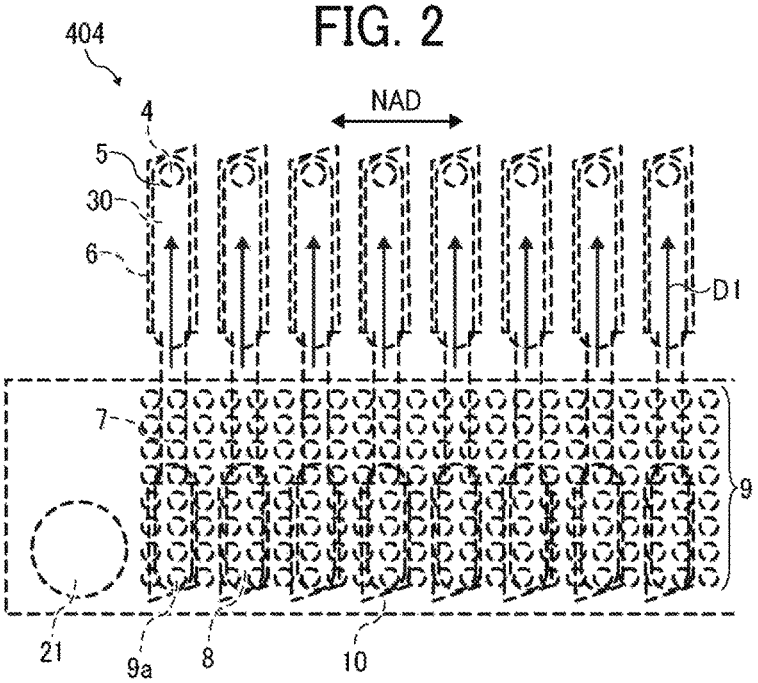
FIG. 2 is a plan view of a portion of the liquid discharge head of FIG. 1.

FIGS. 1 and 2 illustrate a liquid discharge head 404 according to a first embodiment of the present disclosure. FIG. 1 is a cross-sectional view of the head 404 according to the first embodiment along a direction perpendicular to a nozzle array direction, in which nozzles are arrayed in a row indicated by arrow NAD in FIG. 2. FIG. 2 is a plan view of a portion of the head 404 of FIG. 1.

The head 404 includes a nozzle plate 1, a channel substrate 2, and a diaphragm 3 serving as a wall. The nozzle plate 1, the channel substrate 2, and the diaphragm 3 are laminated one on another and bonded to each other. The head 404 includes piezoelectric actuators 11 to displace a vibration portion (vibration plate) 30 of the diaphragm 3, and a common chamber substrate 20 as a frame member of the head 404.

The nozzle plate 1 includes multiple nozzles 4 to discharge liquid.

As illustrated in FIGS. 1 and 2, the channel substrate 2 includes through-holes and grooves that form individual chambers 6, supply-side fluid restrictors 7, and supply-side introduction portions 8. The individual chambers 6 communicate with the nozzles 4 via nozzle communication channels 5. The supply-side fluid restrictors 7 configure a supply channel to communicate with the individual chambers 6. The supply-side introduction portions 8 communicate with the supply-side fluid restrictors 7. The supply-side introduction portions 8 may be configured to communicate with two or more supply-side fluid restrictors 7.

The diaphragm 3 includes deformable vibration portions 30 constituting a wall of the individual chambers 6 of the channel substrate 2. In the present embodiment, the diaphragm 3 has a two-layer structure including a first layer and a second layer. The first layer forms thin portions from the channel substrate 2. The second layer forms thick portions. The first layer includes the deformable vibration portions 30 at positions corresponding to the individual chambers 6. Note that the diaphragm 3 is not limited to the two-layer structure and the number of layers may be any other suitable number.

The piezoelectric actuator 11 is disposed on the opposite side of the individual chamber 6 of the diaphragm 3. The piezoelectric actuator 11 includes an electromechanical transducer element as a driver (e.g., actuator, pressure generator) to deform the vibration portions 30 of the diaphragm 3.

The piezoelectric actuator 11 includes piezoelectric elements 12 bonded on a base 13. The piezoelectric elements 12 are groove-processed by half cut dicing so that each piezoelectric elements 12 includes a desired number of pillar-shaped piezoelectric elements 12 that are arranged in certain intervals in the nozzle array direction (NAD) to have a comb shape.

The piezoelectric element 12 is joined to a convex portion 30*a*, which is a thick portion having an island-like form formed on the vibration portions 30 (vibration plate) of the diaphragm 3.

The piezoelectric element 12 includes piezoelectric layers and internal electrodes alternately laminated. The internal electrodes are lead out to an end face of the piezoelectric element 12 to form external electrodes. The external electrodes are connected to a flexible wiring member 15.

The common chamber substrate 20 includes a supply-side common chamber 10 communicating with a supply port 21 that supplies the liquid from outside the head 404.

The supply-side common chamber 10 is communicated with the supply-side introduction portions 8 via a supply-side filter 9. The supply-side filter 9 includes a large number of filter holes 9*a* and is formed by a first layer of the diaphragm 3.

In the head 404 thus configured, for example, when a voltage lower than a reference potential (intermediate potential) is applied to the piezoelectric element 12, the piezoelectric element 12 contracts. Accordingly, the vibration portion 30 of the diaphragm 3 is pulled inward to increase the volume of the individual chamber 6, thus causing liquid to flow into the individual chamber 6.

When the voltage applied to the piezoelectric element 12 is raised, the piezoelectric element 12 extends in a direction of lamination. Accordingly, the vibration portion 30 of the diaphragm 3 deforms in a direction toward the nozzle 4 and the volume of the individual chamber 6 reduces. Thus, liquid in the individual chamber 6 is pressurized and discharged from the nozzle 4.

Note that the driving method of the head 404 is not limited to the above-described example (pull-push discharge). For example, pull discharge or push discharge may be performed in response to the way to apply the drive waveform to the head 404.

Next, the configuration and arrangement of the fluid restrictor and the filter in the present embodiment is described.

The channel substrate 2 is formed by laminating four plate members 2A, 2B, 2C, and 2D from the nozzle plate 1 side. The diaphragm 3 forming the supply-side filter 9 is joined and laminated to the plate member 2D.

The supply-side fluid restrictor 7 is configured by plate members 2C, 2B, and 2A, and both end positions (inlet position and outlet position) in the nozzle array direction (NAD) are defined by the plate member 2C.

The plate member 2D is interposed between the plate member 2C and the diaphragm 3. The plate member 2C is a first plate member forming the supply-side fluid restrictor 7. The diaphragm 3 is a second plate member forming the supply-side filter 9. The plate member 2D is a third plate member. A gap 18 is provided between the plate member 2C and the diaphragm 3 by the plate member 2D. Thus, the plate member 2D (third plate) intervenes between the plate member 2C (first plate) and the diaphragm 3 (second plate) to form the gap 18 between a wall of the inlet 7*a* of the supply-side fluid restrictor 7 (supply channel) and the supply-side filter 9.

In this configuration, the liquid flows in the supply-side fluid restrictor 7 in a supply direction D1 (first direction) along the surface of the supply-side filter 9, the supply direction D1 (first direction) intersecting (here, orthogonal to) a permeation direction D2 (second direction) Din which the liquid permeates the supply-side filter 9.

The plate member 2C forming the supply-side fluid restrictor 7 is projected toward the supply-side introduction portion 8 while maintaining the gap 18 with the supply-side filter 9 by the plate member 2D. Thus, the supply-side fluid restrictor 7 (supply channel) is disposed at a position where an inlet 7*a* of the supply-side fluid restrictor 7 (supply channel) and the supply-side filter 9 overlaps in the permeation direction D2 in which the liquid permeates the supply-side filter 9.

Thus, a portion corresponding to the inlet 7*a* of the plate member 2C that forms the supply-side fluid restrictor 7 faces the supply-side filter 9 with the gap 18 between the portion and the supply-side filter 9.

As described above, disposing the inlet 7*a* of the supply-side fluid restrictor 7 to be overlapped with the supply-side filter 9 in the permeation direction D2 prevents an arrangement position of the supply-side fluid restrictor 7 to be affected by the position of the supply-side filter 9.

Thus, the present embodiment can enlarge a filter area of the supply-side filter 9 without changing the arrangement position of the supply-side fluid restrictor 7. Therefore, the present embodiment can prevent an increase in size of the head 404 owing to the increase in the filter area of the supply-side filter 9.

Here, the present embodiment has a configuration in which the supply-side introduction portion 8 is directly connected to the supply-side fluid restrictor 7. However, the present embodiment is not limited to this configuration. For example, the present embodiment may have a configuration in which a fluid restrictor is provided at a part of an individual supply channel that connects the supply-side introduction portion 8 and the individual chamber 6.

In this case, disposing an inlet 7*a* of the individual supply channel to be overlapped with the supply-side filter 9 in the permeation direction D2 prevents an arrangement position of the individual supply channel (supply-side fluid restrictor 7) to be affected by the position of the supply-side filter 9.

This point is described with reference also to the comparative example illustrated in FIG. 3.

In this comparative example, the wall of the supply-side fluid restrictor 7 is formed by the diaphragm 3 forming the supply-side filter 9.

Therefore, even when the inlet 7*a* of the supply-side fluid restrictor 7 is arranged to be close to the supply-side filter 9, the inlet 7*a* becomes closer to the individual chamber 6 side than an end E of the supply-side filter 9 in the direction perpendicular to the nozzle array direction (NAD).

Figure 3:
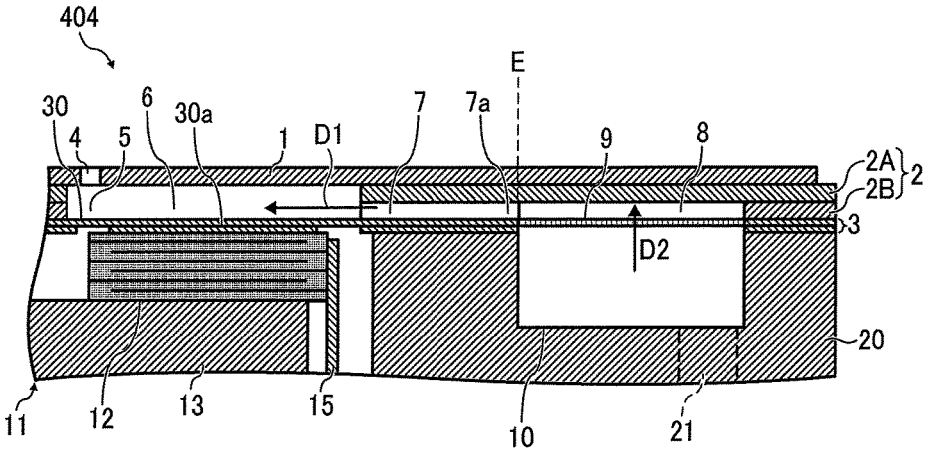
FIG. 3 is a cross-sectional view of a liquid discharge head of a comparative example along the direction perpendicular to the nozzle array direction.

Therefore, in order to secure a fluid resistance of the supply-side fluid restrictor 7, the size of the head 404 increases unlike the present embodiment because the comparative example in FIG. 3 cannot increase the filter area of the supply-side filter 9 toward the individual chamber 6 side.

Figure 4:
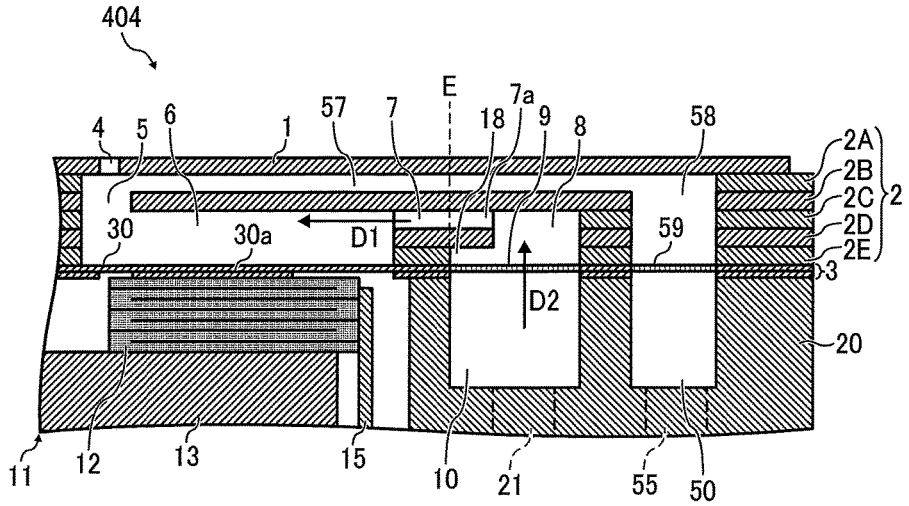
FIG. 4 is a cross-sectional view of the liquid discharge head according to a second embodiment of the present disclosure in the direction perpendicular to the nozzle array direction.

FIG. 4 illustrates the head 404 according to a second embodiment of the present disclosure. FIG. 4 is a cross-sectional view of the head 404 in a direction perpendicular to the nozzle array direction (NAD).

This head 404 is a circulation type head. Here, a discharge-side fluid restrictor 57 and a discharge-side introduction portion 58 are formed by laminating five plate members 2A to 2E. The discharge-side fluid restrictor 57 and the discharge-side introduction portion 58 configure a discharge channel communicating with the individual chamber 6 via the nozzle communication channel 5.

The common chamber substrate 20 forms the supply-side common chamber 10 and a discharge-side common chamber 50. Further, the diaphragm 3 forms a discharge-side filter 59 disposed between the discharge-side introduction portion 58 and the discharge-side common chamber 50. The supply-side common chamber 10 communicates the supply port 21 from which the liquid outside the head 404 is supplied to the supply-side common chamber 10. The discharge-side common chamber 50 communicates a discharge port 55 from which the liquid in the discharge-side common chamber 50 is discharged outside the head 404.

Arrangement and configuration of the supply-side fluid restrictor 7 and the supply-side filter 9 in FIG. 4 are similar to the arrangement and the configuration in the first embodiment illustrated in FIG. 1.

Figure 5:
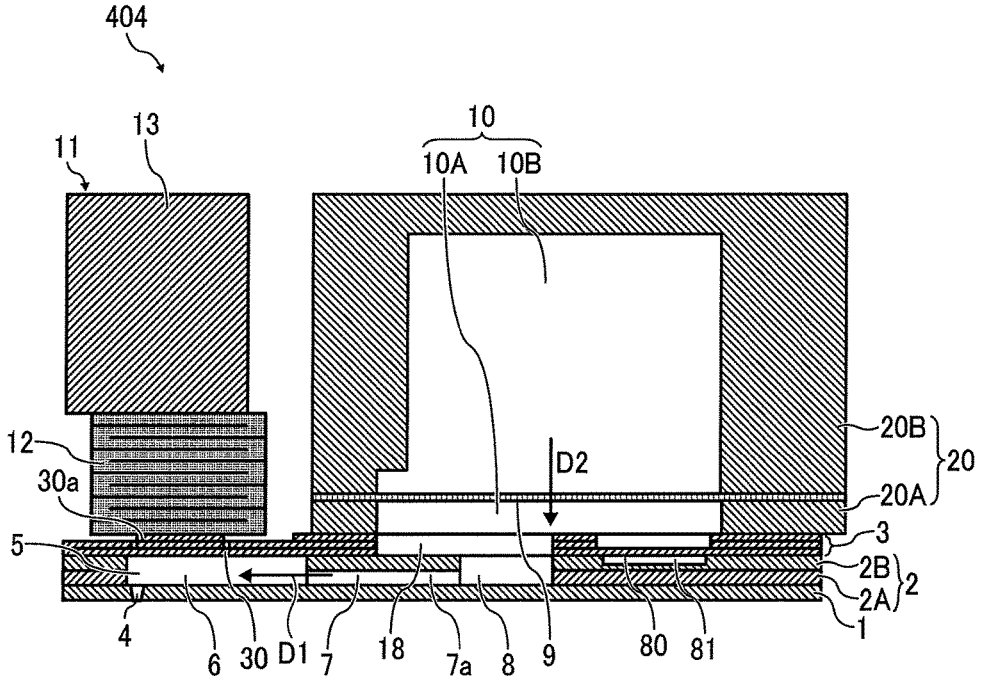
FIG. 5 is a cross-sectional view of the liquid discharge head according to a third embodiment of the present disclosure in the direction perpendicular to the nozzle array direction.

FIG. 5 illustrates the head 404 according to a third embodiment of the present disclosure. FIG. 5 is a cross-sectional view of the head 404 in a direction perpendicular to a nozzle array direction (NAD).

The common chamber substrate 20 of the head 404 is configured by a first member 20A and a second member 20B. The filter 9 is arranged between the first member 20A and the second member 20B to form a downstream common chamber 10A and an upstream common chamber 10B.

The head 404 includes a damper 80 that forms a wall of the downstream common chamber 10A using one layer of the diaphragm 3. The channel substrate 2 forms a damper room 81 at a position opposite the downstream common chamber 10A via the damper 80.

As described above, the configuration in which the damper 80 is disposed in the head 404 can also suppress the increase in size of the head 404 since the arrangement position of the supply-side fluid restrictor 7 is not affected by the supply-side filter 9.

Figure 6:
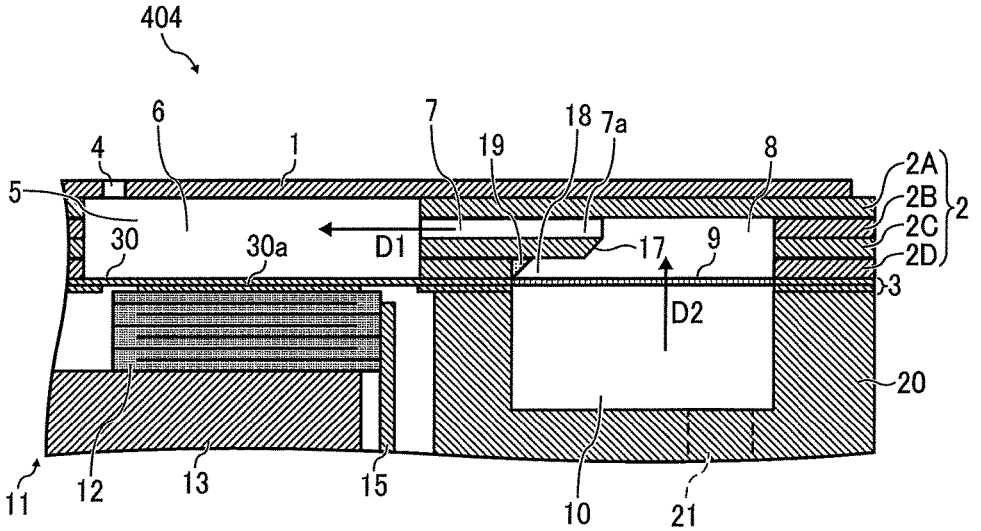
FIG. 6 is a cross-sectional view of the liquid discharge head according to a fourth embodiment of the present disclosure in the direction perpendicular to the nozzle array direction.

FIG. 6 illustrates the head 404 according to a fourth embodiment of the present disclosure. FIG. 6 is a cross-sectional view of the head 404 in a direction perpendicular to the nozzle array direction (NAD).

The present embodiment includes an inclined surface 17 at an end face (the end face in a direction perpendicular to the nozzle array direction (NAD)) forming the inlet 7*a* of the supply-side fluid restrictor 7 of the plate member 2C in the head 404 according to the first embodiment illustrated in FIG. 1. Further, joint material 19 is applied at a boundary between the plate member 2C and the end face of the plate member 2D (the end face in the direction perpendicular to the nozzle array direction (NAD)) to reduce corner edges.

As a result, the liquid filtering through the supply-side filter 9 can smoothly flow through an inside of the supply-side introduction portion 8 and into the supply-side fluid restrictor 7.

That is, the liquid that passed through a region of the supply-side filter 9 opposed to the inlet 7*a* of the supply-side fluid restrictor 7 is directed to the outer wall of the plate member 2C forming the inlet 7*a*. At this time, if the end face of the plate member 2C is angular, or if the joint between the outer wall of the plate member 2C and the end face of the plate member 2D is angular, turbulence occurs in the flow of the liquid.

Thus, the flow of the liquid flowing into the inlet 7*a* of the supply-side fluid restrictor 7 may be disturbed that hinders a stable liquid supply. Therefore, the present embodiment can stably supply the liquid to the individual chamber 6 by smoothing the liquid flow in the supply-side introduction portion 8.

Figure 7:
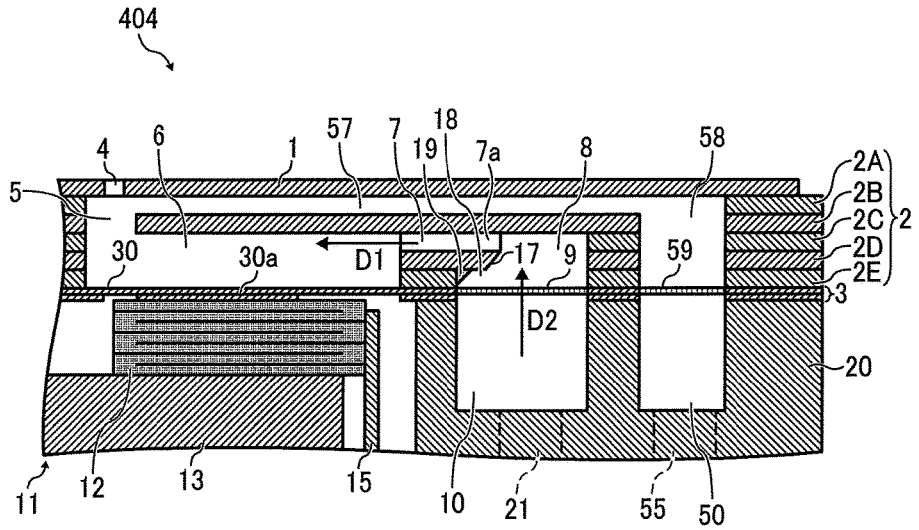
FIG. 7 is a cross-sectional view of the liquid discharge head according to a fifth embodiment of the present disclosure in the direction perpendicular to the nozzle array direction.

FIG. 7 illustrates the head 404 according to a fifth embodiment of the present disclosure. FIG. 7 is a cross-sectional view of the head 404 in a direction perpendicular to the nozzle array direction (NAD).

The present embodiment includes the inclined surface 17 at an end face (the end face in a direction perpendicular to the nozzle array direction (NAD)) forming the inlet 7*a* of the supply-side fluid restrictor 7 of the plate member 2D in the head 404 according to the second embodiment illustrated in FIG. 4. Further, the joint material 19 is applied at a boundary between the plate member 2D and the end face of the plate member 2E (the end face in the direction perpendicular to the nozzle array direction (NAD)) to reduce the corner edges.

Thus, as in the fourth embodiment, the liquid filtering through the supply-side filter 9 can flow smoothly through an inside of the supply-side introduction portion 8 and into the supply-side fluid restrictor 7.

The difference of the fourth embodiment in FIG. 6 and the fifth embodiment in FIG. 7 is that the fifth embodiment of the head 404 in FIG. 7 is the circulation type head including the discharge-side fluid restrictor 57 and the discharge-side introduction portion 58 as illustrated in FIG. 4.

Figure 8:
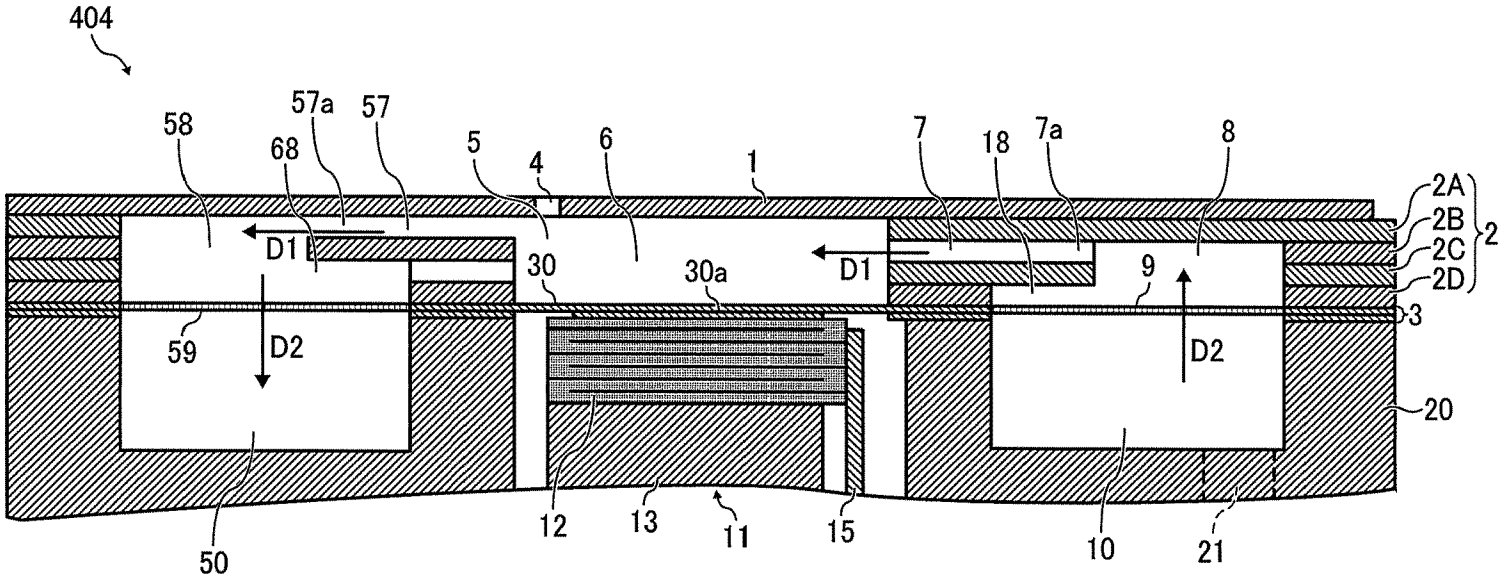
FIG. 8 is a cross-sectional view of the liquid discharge head according to a sixth embodiment of the present disclosure in the direction perpendicular to the nozzle array direction.

FIG. 8 illustrates the head 404 according to a sixth embodiment of the present disclosure. FIG. 8 is a cross-sectional view of the head 404 in a direction perpendicular to the nozzle array direction (NAD).

The head 404 according to the present embodiment is a circulation type head in which a supply system is disposed on one side and a discharge system is disposed on another side with a nozzle 4 interposed between the supply system and the discharge system in a direction perpendicular to the nozzle array direction (NAD).

That is, the supply-side common chamber 10, the supply-side filter 9, the supply-side introduction portion 8, and the supply-side fluid restrictor 7 are disposed at the one side of the head 404. The liquid is supplied from the supply-side common chamber 10 to the individual chamber 6.

The discharge-side fluid restrictor 57, the discharge-side introduction portion 58, the discharge-side filter 59, and the discharge-side common chamber 50 are disposed at the another side of the head 404. The liquid is discharged from the individual chamber 6 to the discharge-side common chamber 50.

Here, the discharge-side fluid restrictor 57 is constituted by the nozzle plate 1 and the plate members 2A and 2B. A gap 68 is provided between the plate member 2B and the diaphragm 3 by disposing the plate members 2C and 2D between the plate member 2B forming the discharge-side fluid restrictor 57 and the diaphragm 3 forming the discharge-side filter 59.

In this configuration, a supply direction D1 (first direction) of the flow of the liquid in the discharge-side fluid restrictor 57 is along a direction of the surface of the discharge-side filter 59. The supply direction D1 (first direction) intersects (here, perpendicular to) a permeation direction D2 (second direction) of the liquid that permeates the discharge-side filter 59.

Then, the plate member 2B forming the discharge-side fluid restrictor 57 is projected toward the discharge-side introduction portion 58 by the plate members 2C and 2D while maintaining the gap 68. Thus, the discharge-side fluid restrictor 57 is disposed at a position where an outlet 57*a* of the discharge-side fluid restrictor 57 and the discharge-side filter 59 overlaps in the permeation direction D2 of the liquid that filters through the discharge-side filter 59.

Thus, a portion corresponding to the outlet 57*a* of the plate member 2B that forms the discharge-side fluid restrictor 57 faces the discharge-side filter 59 with the gap 68 between the portion and the discharge-side filter 59.

Thus, the present embodiment can enlarge a filter area of the discharge-side filter 59 while preventing an increase in size of the head 404 because the arrangement position of the discharge-side fluid restrictor 57 is not affected by the discharge-side filter 59.

Figure 9:
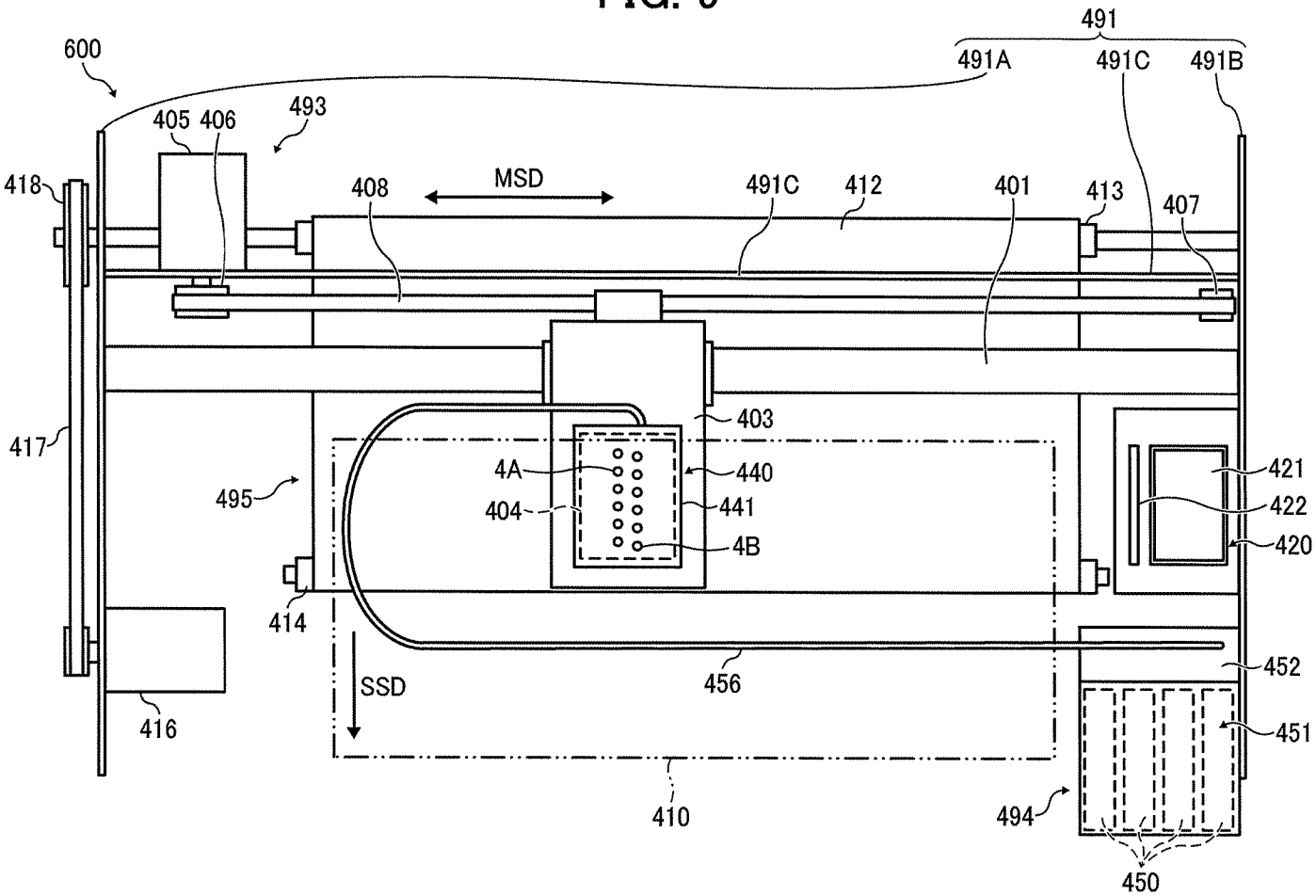
FIG. 9 is a plan view of a portion of a liquid discharge apparatus according to an embodiment of the present disclosure.
Figure 10:
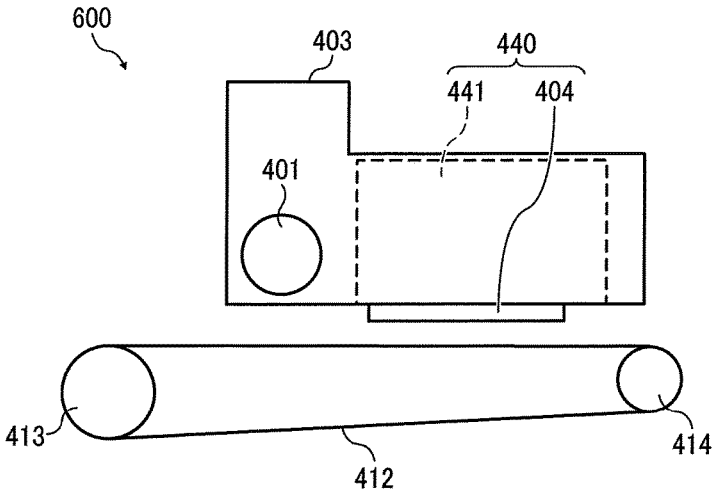
FIG. 10 is a side view of a portion of the liquid discharge apparatus of FIG. 9.

FIGS. 9 and 10 illustrate an example of a liquid discharge apparatus 600 according to the present embodiment. FIG. 9 is a plan view of a main part of the liquid discharge apparatus 600. FIG. 10 is a side view of a main part of the liquid discharge apparatus 600.

The liquid discharge apparatus 600A is a serial type apparatus in which a main scan moving unit 493 reciprocally moves a carriage 403 in a main scanning direction indicated by arrow MSD in FIG. 9. The main scan moving unit 493 includes a guide 401, a main scanning motor 405, a timing belt 408, etc.

The guide 401 is laterally bridged between a left side plate 491A and a right side plate 491B and supports the carriage 403 so that the carriage 403 is movable along the guide 401. The main scanning motor 405 (drive unit) reciprocally moves the carriage 403 in the main scanning direction MSD via the timing belt 408 laterally bridged between a drive pulley 406 and a driven pulley 407.

The carriage 403 mounts a liquid discharge device 440 in which the head 404 according to the present embodiment and a head tank 441 are integrated as a single unit. The head 404 of the liquid discharge device 440 discharges color liquids of, for example, yellow (Y), cyan (C), magenta (M), and black (K). The head 404 includes nozzle arrays 4A and 4B, each including the plurality of nozzles 4 arrayed in row in a sub-scanning direction indicated by arrow SSD in FIG. 9. The sub-scanning direction (SSD) is perpendicular to the main scanning direction MSD and along the nozzle array direction NAD. The head 404 is mounted to the carriage 403 so that ink droplets are discharged downward.

The liquid stored outside the head 404 is supplied to the head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 600 includes a conveyance unit 495 to convey a sheet 410. The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the head 404. The conveyance belt 412 is in the form of an endless belt. The conveyance belt 412 is stretched between a conveyance roller 413 and a tension roller 414. The sheet 410 is attracted to the conveyance belt 412 by electrostatic force or air suction, for example.

The conveyance roller 413 is rotated by a sub-scanning motor 416 via a timing belt 417 and a timing pulley 418, so that the conveyance belt 412 circulates in a sub-scanning direction (SSD) in FIG. 9.

At one side in the main scanning direction (MSD) of the carriage 403, a maintenance unit 420 to recover the head 404 in good condition is disposed on a lateral side (right-hand side) of the conveyance belt 412 in FIG. 9.

The maintenance unit 420 includes, for example, a cap 421 to cap a nozzle face of the head 404 and a wiper 422 to wipe the nozzle face. The nozzle face is a surface of the nozzle plate 1 in which the nozzles 4 are formed.

The main scan moving unit 493, the supply unit 494, the maintenance unit 420, and the conveyance unit 495 are mounted to a housing 491 that includes the left side plate 491A, the right side plate 491B, and a rear side plate 491C.

In the liquid discharge apparatus 600 thus configured, a sheet 410 is conveyed on and attracted to the conveyance belt 412 and is conveyed in the sub-scanning direction (SSD) by the cyclic rotation of the conveyance belt 412.

The head 404 is driven in response to image signals while the carriage 403 moves in the main scanning direction (MSD), to discharge liquid to the sheet 410 stopped, thus forming an image on the sheet 410.

As described above, the liquid discharge apparatus 600 includes the head 404 according to the present embodiment, thus allowing stable formation of high quality images.

Figure 11:
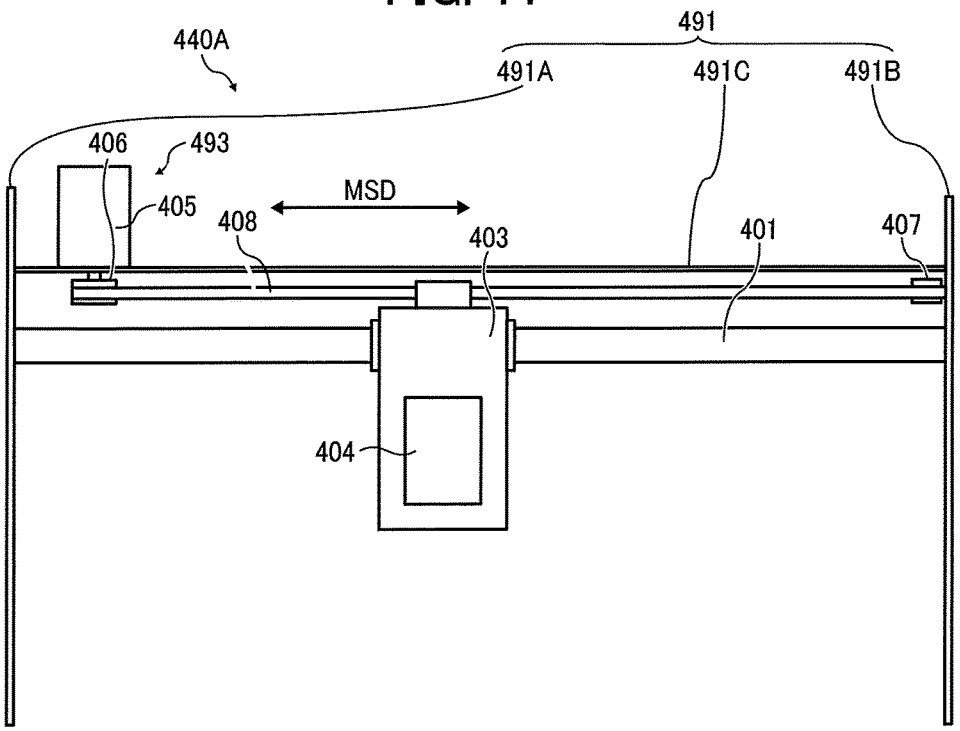
FIG. 11 is a plan view of an example of a portion of a liquid discharge device according to another embodiment of the present disclosure.

FIG. 11 illustrates another example of the liquid discharge device 440A according to another embodiment of the present disclosure. FIG. 11 is a plan view of a main part of the liquid discharge device 440A.

The liquid discharge device 440A includes the housing 491, the main scan moving unit 493, the carriage 403, and the head 404 among components of the liquid discharge apparatus 600. The left side plate 491A, the right side plate 491B, and the rear side plate 491C constitute the housing 491.

Note that, in the liquid discharge device 440A, at least one of the maintenance unit 420 and the supply unit 494 described above may be mounted on, for example, the right side plate 491B.

Figure 12:
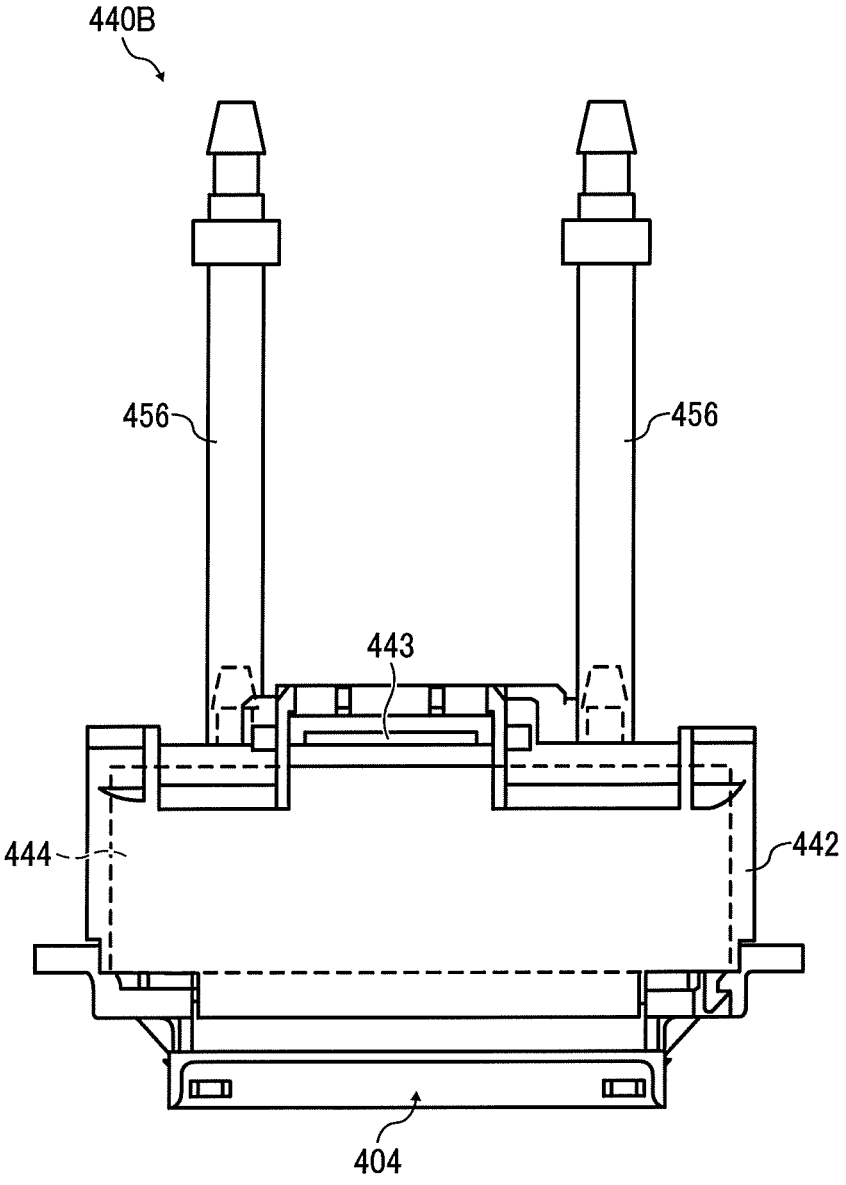
FIG. 12 is a front view of another example of the liquid discharge device according to the present disclosure.

FIG. 12 illustrates still another example of the liquid discharge device 440B according to an embodiment of the present disclosure. FIG. 12 is a front view of the liquid discharge device 440B.

The liquid discharge device 440B includes the head 404 to which a channel part 444 is mounted and a tube 456 connected to the channel part 444.

Further, the channel part 444 is disposed inside a cover 442. Instead of the channel part 444, the liquid discharge device 440B may include the head tank 441. A connector 443 to electrically connect the head 404 to a power source is disposed above the channel part 444.

Figure 13:
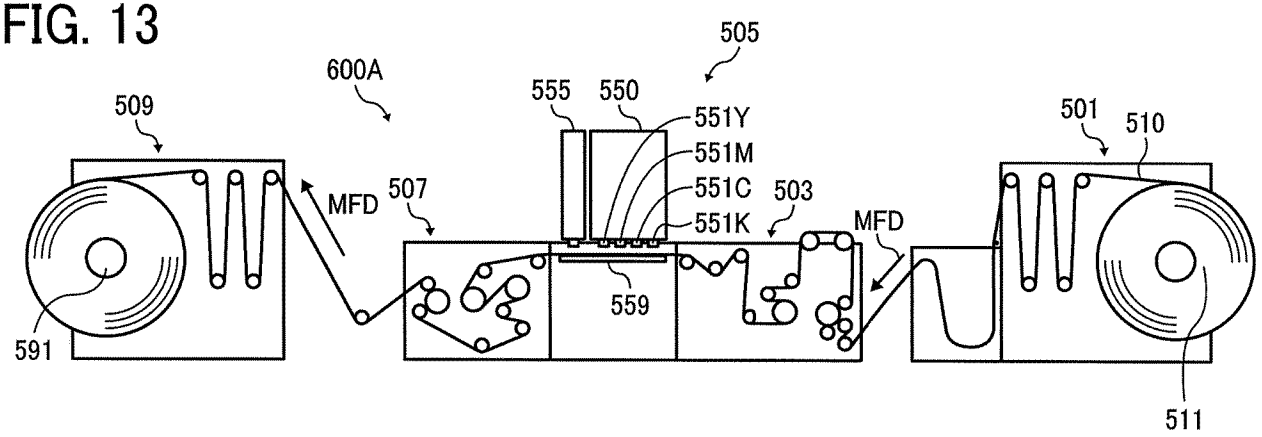
FIG. 13 is a front view of a liquid discharge apparatus according to still another embodiment of the present disclosure.
Figure 14:
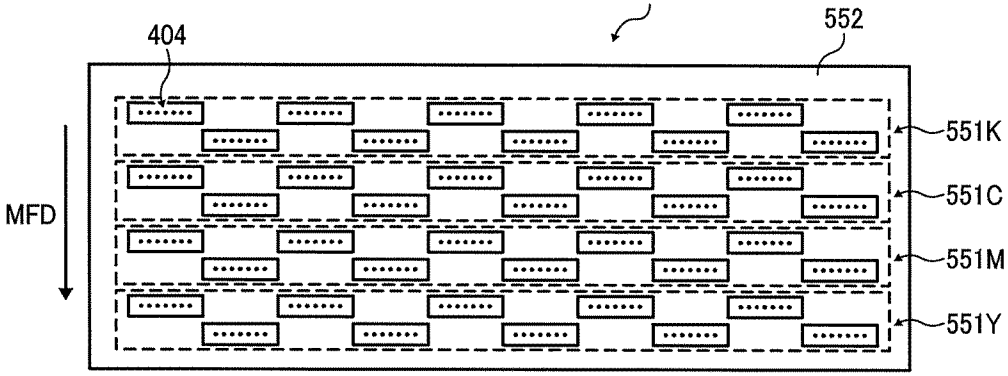
FIG. 14 is a plan view of a head unit of the liquid discharge apparatus of FIG. 13.

FIGS. 13 and 14 illustrate an example of a liquid discharge apparatus 600A according to the present disclosure. FIG. 13 is a schematic front view of the liquid discharge apparatus 600A. FIG. 14 is a plan view of a head unit 550 of the liquid discharge apparatus 600A in FIG. 13.

The liquid discharge apparatus 600A according to the present embodiment includes a feeder 501 to feed a medium 510, a guide conveyor 503 to guide and convey the medium 510, fed from the feeder 501, to a printing unit 505, the printing unit 505 to discharge liquid onto the medium 510 to form an image on the medium 510, a drier unit 507 to dry the medium 510, and an ejector 509 to eject the medium 510. The medium 510 is a continuous medium such as a rolled sheet.

The medium 510 is fed from a winding roller 511 of the feeder 501, guided and conveyed with rollers of the feeder 501, the guide conveyor 503, the drier unit 507, and the ejector 509, and wound around a take-up roller 591 of the ejector 509.

In the printing unit 505, the medium 510 is conveyed opposite a first head unit 550 and a second head unit 555 on a conveyance guide 559. The first head unit 550 discharges liquid to form an image on the medium 510. Post-treatment is performed on the medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the medium 510 (hereinafter, "medium feed direction") indicated by arrow MFD in FIG. 13.

The head arrays 551K, 551C, 551M, and 551Y are liquid dischargers to discharge liquid of black (K), cyan (C), magenta (M), and yellow (Y) onto the medium 510 conveyed on the conveyance guide 559. Note that the number and types of color are not limited to the above-described four colors of K, C, M, and Y and may be any other suitable number and types.

In each head array 551, for example, as illustrated in FIG. 14, the heads 404 according to the present embodiment are staggered on a base 552 to form the head array 551. Note that the configuration of the head array 551 is not limited to such a configuration.

Figure 15:
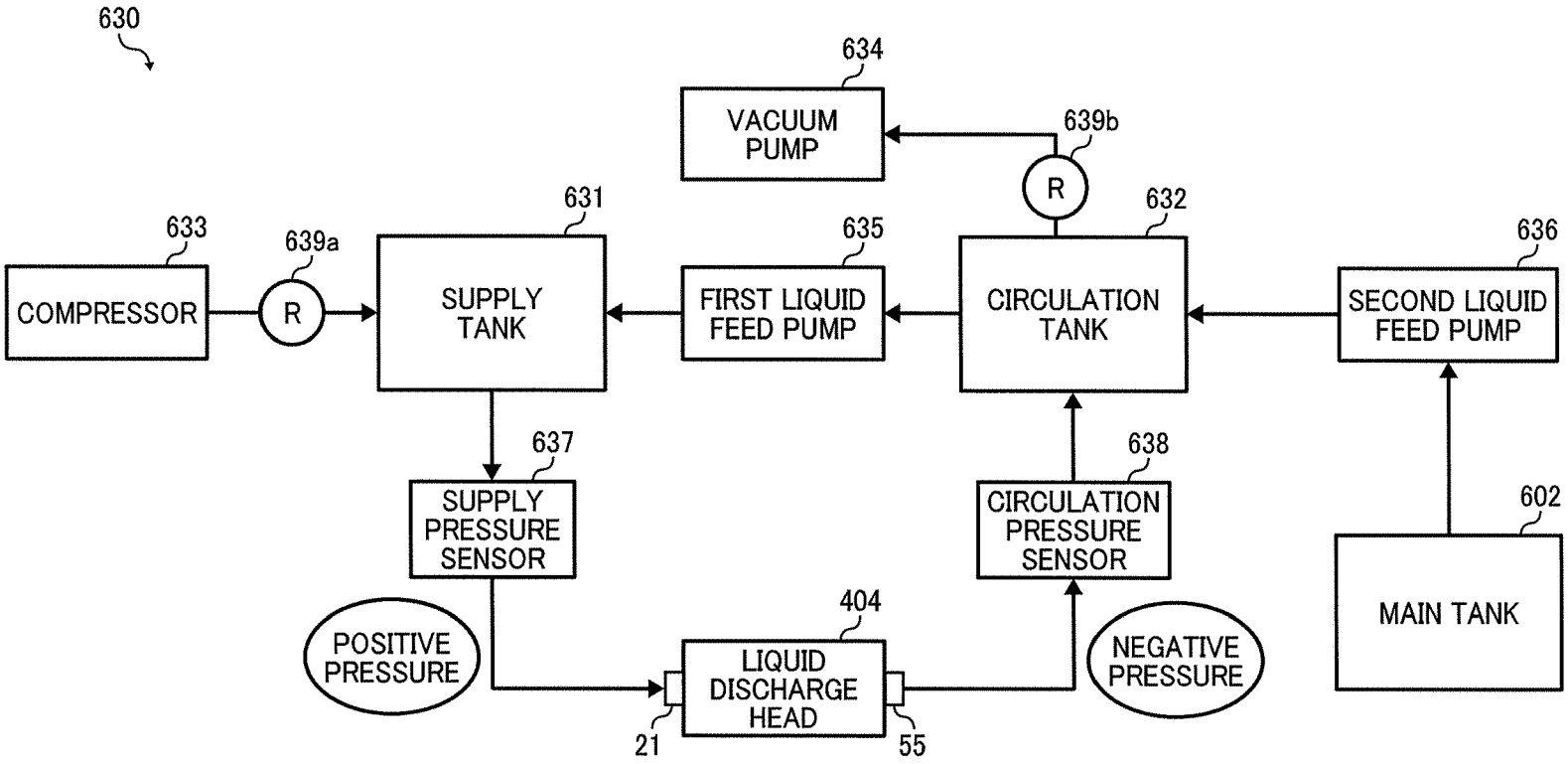
FIG. 15 is a block diagram of a liquid circulation system of the liquid discharge apparatus of FIG. 13.

Next, an example of a liquid circulation system according to an embodiment of the present disclosure is described with reference to FIG. 15. FIG. 15 is a block diagram of the liquid circulation system according to an embodiment of the present disclosure.

As illustrated in FIG. 15, the liquid circulation system 630 includes a main tank 602, the heads (liquid discharge heads) 404, a supply tank 631, a circulation tank 632, a compressor 633, a vacuum pump 634, a first liquid feed pump 635, a second liquid feed pump 636, a supply pressure sensor 637, a circulation pressure sensor 638, and a regulator (R) 639*a* and 639*b*.

The supply pressure sensor 637 is disposed between the supply tank 631 and the heads 404 and connected to a supply channel connected to a supply port 21 of the heads 404 (See FIG. 4). The circulation pressure sensor 638 is disposed between the circulation tank 632 and the heads 404 and connected to a discharge channel connected to the discharge port 55 of the heads 404 (See FIG. 4).

One end of the circulation tank 632 is connected with the supply tank 631 via the first liquid feed pump 635 and the other end of the circulation tank 632 is connected with the main tank 602 via the second liquid feed pump 636.

Thus, liquid is flown from the supply tank 631 into the heads 404 through the supply port 21 and discharged from the discharge port 55 to the circulation tank 632. Further, the first liquid feed pump 635 feeds liquid from the circulation tank 632 to the supply tank 631, thus circulating liquid.

The supply tank 631 is connected to the compressor 633 and controlled so that a predetermined positive pressure is detected with the supply pressure sensor 637. The circulation tank 632 is connected to the vacuum pump 634 and controlled so that a predetermined negative pressure is detected with the circulation pressure sensor 638.

Such a configuration allows the menisci of ink to be maintained at a constant negative pressure while circulating ink through the inside of the heads 404.

When the liquid is discharged from the nozzles 4 of the heads 404, the amount of liquid in each of the supply tank 631 and the circulation tank 632 decreases. Hence, the second liquid feed pump 636 properly replenishes the liquid from the main tank 602 to the circulation tank 632. A timing of replenishing the liquid from the main tank 602 to the circulation tank 632 is controlled in accordance with a result of detection with, e.g., a liquid level sensor in the circulation tank 632, for example, in a manner in which liquid is replenished when the liquid level of liquid in the circulation tank 632 is lower than a predetermined height.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The "liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a main scan moving unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank are integrated as the liquid discharge device. The head and the head tank may be connected each other via, e.g., a tube to integrally form the liquid discharge device. Here, a unit including a filter may further be added to a portion between the head tank and the head of the liquid discharge device.

The liquid discharge device may be an integrated unit in which a head is integrated with a carriage.

The liquid discharge device may be the head movably held by a guide that forms part of a main scan moving unit, so that the head and the main scan moving unit are integrated as a single unit. The liquid discharge device may include the head, the carriage, and the main scan moving unit that are integrated as a single unit.

In another example, the cap that forms part of the maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as a liquid cartridge to the head through the tube.

The main scan moving unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid onto a material to which liquid can adhere or an apparatus to discharge liquid into gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge in layers a fabrication liquid onto a powder layer in which powder material is formed, so as to form a three-dimensional object.

In addition, "the liquid discharge apparatus" is not limited to an apparatus that forms visible meaningful images, such as letters or figures, with discharged liquid. Thus, for example, the liquid discharge apparatus may be an apparatus to form meaningless images, such as meaningless patterns, or fabricate three-dimensional images.

The above-described term "material on which liquid can be adhered" means material on which liquid is at least temporarily adhered, a material on which liquid is adhered and fixed, or a material into which liquid is adhered to permeate.

Examples of a "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a nozzle from which liquid is discharged;

an individual chamber communicating with the nozzle;

a supply channel communicating with the individual chamber, the liquid flowing through the supply channel in a first direction; and a filter disposed upstream of the supply channel, the liquid filtering through the filter in a second direction that intersects with the first direction, the supply channel including an inlet disposed at a position overlapping the filter in the second direction, an opening of the inlet of the supply channel lying in a plane that intersects with the first direction.

2. The liquid discharge head according to claim 1, further comprising:

a first plate forming the supply channel;

a second plate forming the filter; and a third plate intervening between the first plate and the second plate to form a gap between a wall of the inlet of the supply channel and the filter.

3. The liquid discharge head according to claim 1, further comprising a discharge channel communicating with the individual chamber.

4. The liquid discharge head according to claim 1, wherein the supply channel includes a fluid restrictor to restrict flow of the liquid in the fluid restrictor.

5. The liquid discharge head according to claim 4, wherein the fluid restrictor includes the inlet disposed at a position overlapping the filter in the second direction.

6. A liquid discharge device comprising the liquid discharge head according to claim 1.

7. The liquid discharge device according to claim 6, further comprising at least one of:

a head tank to store the liquid to be supplied to the liquid discharge head;

a carriage to mount the liquid discharge head;

a supply unit to supply the liquid to the liquid discharge head;

a maintenance unit to maintain the liquid discharge head; and a drive unit to move the carriage in a main scanning direction, to be integrated with the liquid discharge head as a single unit.

8. A liquid discharge apparatus comprising the liquid discharge device according to claim 6.

9. The liquid discharge head according to claim 1, wherein the opening of the inlet of the supply channel is disposed to overlap the filter at a position that is between opposing ends of the filter in the first direction.

10. A liquid discharge head, comprising:

a nozzle from which liquid is discharged;

an individual chamber communicating with the nozzle;

a supply-side fluid restrictor communicating with the individual chamber;

a discharge-side fluid restrictor communicating with the individual chamber, the liquid flowing through the discharge-side fluid restrictor in a first direction; and a discharge-side filter disposed downstream of the discharge-side fluid restrictor, the liquid filtering through the discharge-side filter in a second direction that intersects with the first direction, the discharge-side fluid restrictor including an outlet disposed at a position overlapping the discharge-side filter in the second direction, an opening of the outlet of the discharge-side fluid restrictor lying in a plane that intersects with the first direction.

11. The liquid discharge head according to claim 10, wherein the opening of the outlet of the discharge-side fluid restrictor is disposed to overlap the filter at a position that is between opposing ends of the discharge-side filter in the first direction.

* * * * *